United States Patent [19]

Lin

[11] Patent Number: 4,752,090

[45] Date of Patent: Jun. 21, 1988

[54] AUXILIARY LOCK WITH AN EXTENSIBLE DEVICE

[76] Inventor: Jui C. Lin, 297 Bor Ay Rd., Kaohsiung, Taiwan

[21] Appl. No.: 929,347

[22] Filed: Nov. 12, 1986

[51] Int. Cl.[4] ..... E05C 1/16

[52] U.S. Cl. ..... 292/1; 292/337; 292/DIG. 60

[58] Field of Search ..... 292/337, DIG. 60, 169, 292/1, 167; 70/134, 448

[56] References Cited

U.S. PATENT DOCUMENTS

| | | | |
|---|---|---|---|
| 1,661,454 | 3/1928 | Wilson | 70/448 |
| 2,586,066 | 2/1952 | Larson | 292/337 |
| 2,822,202 | 2/1958 | Welch | 292/337 X |
| 2,937,897 | 5/1960 | Soderberg | 292/1 |
| 4,372,594 | 2/1983 | Gater | 292/337 |
| 4,564,229 | 1/1986 | Mullich et al. | 292/337 X |
| 4,593,542 | 6/1986 | Rotondi et al. | 292/DIG. 60 |
| 4,602,490 | 7/1986 | Glass et al. | 292/DIG. 60 |
| 4,639,025 | 1/1987 | Fann et al. | 292/1 |
| 4,653,787 | 3/1987 | Fang | 292/337 |
| 4,662,665 | 5/1987 | Lin | 292/337 X |
| 4,664,433 | 5/1987 | Solovieff | 292/337 |
| 4,687,239 | 8/1987 | Lin | 292/DIG. 60 |

*Primary Examiner*—Gary L. Smith
*Assistant Examiner*—Eric K. Nicholson
*Attorney, Agent, or Firm*—Holman & Stern

[57] ABSTRACT

This auxiliary lock has a main cylinder, an extending cylinder, a linking plate, a dead bolt, an assembling plate and a fixing plate that, through the screwed notch and a fixing pin can connect selectively together in a short or long position and is therefore able to change the distance between the fixing plate and the assembling plate.

3 Claims, 5 Drawing Sheets

AUXILIARY LOCK WITH AN EXTENSIBLE DEVICE

BACKGROUND OF THE INVENTION

An auxiliary lock is an extra reinforcing device for safety. When fixing this lock in a door a long latitudinal groove needs to be cut on the side surface of a door so as to fit the lock in, and a turning hole then is cut in the front surface of the door to fit with the intersecting crossed hole of the lock. The crossed hole is a rotatable member having a cross-shaped opening.

Usually, locks nowadays manufactured have a certain definite distance between its crossed hole and faceplate. So users have to properly select the size of a lock according to the structure of a door; namely, the length of the long latitudinal groove in the door, that the lock is to be fixed on. But, in order to satisfy different needs, manufactureres have to make auxiliary locks of different sizes, retailers are obliged to devote more space for storing them, and besides, buyers may feel at a loss in selecting them.

SUMMARY OF THE INVENTION

In order to solve the problems in the art mentioned above, the present invention has been worked out to provide auxiliary locks to alter the distance between its crossed hole and the faceplate, depending on the door it is to be mounted upon.

BRIEF DECRIPTION OF THE DRAWINGS

DETAILED DESCRIPTION OF THE INVENTION

Figure 1:
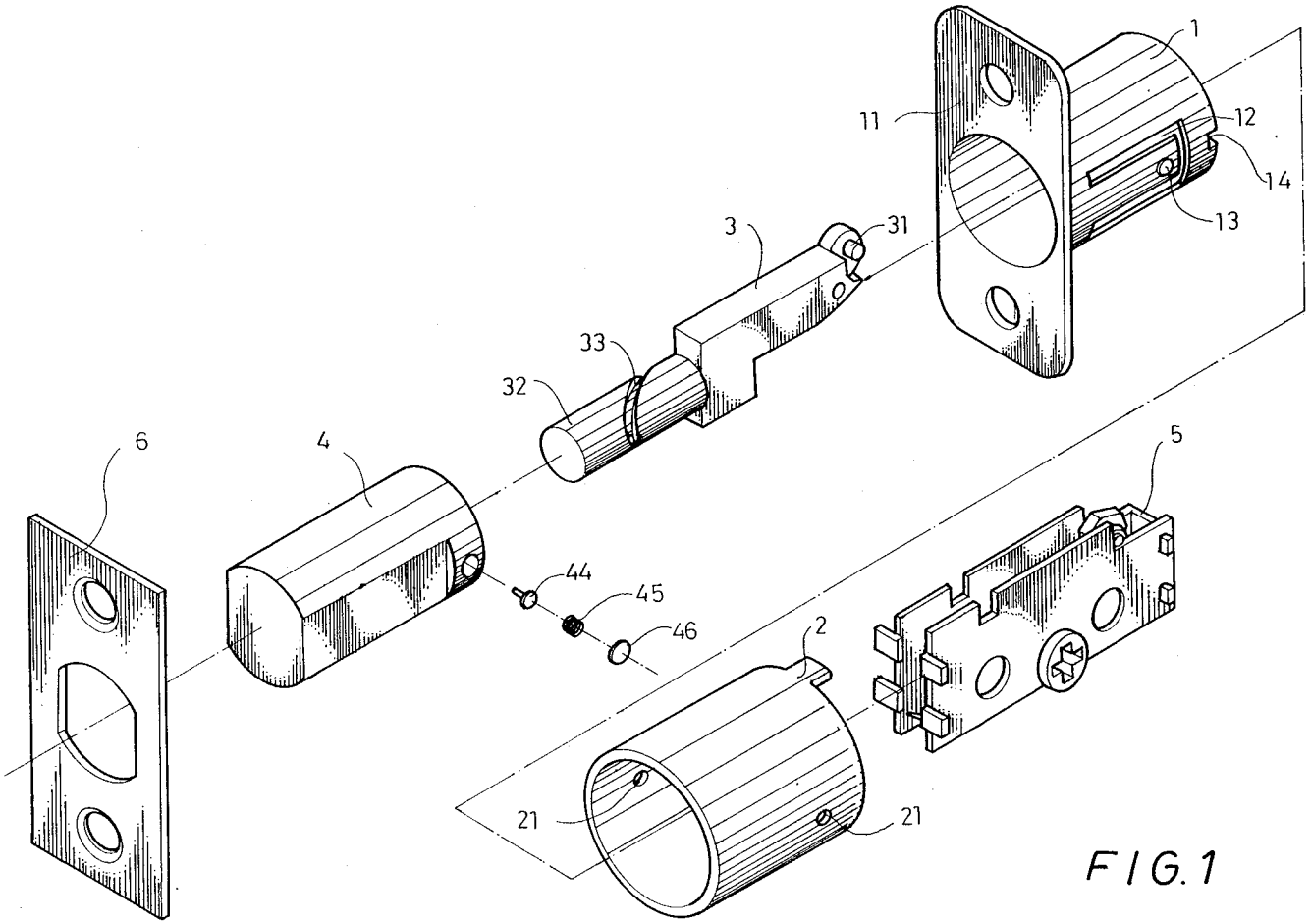
FIG. 1 is an explosive perspective view of the auxiliary lock of the present invention.

First, as shown in FIG. 1, an assembly view of the present invention, this invention comprises main cylinder 1, extending cylinder 2, linking plate 3, dead bolt 4, assembling plate 5 and fixing plate 6.

Figure 2:
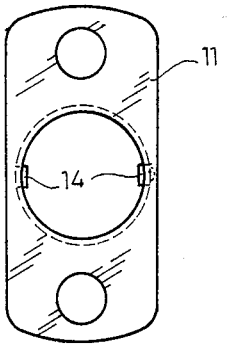
FIG. 2 is a left side view of the cylinder of the present invention.
Figure 3:
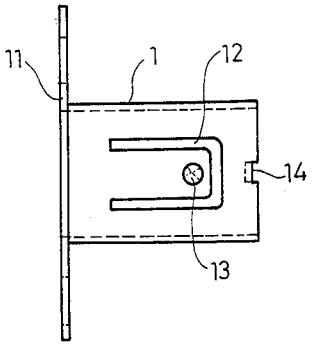
FIG. 3 is a front view of the cylinder of the present invention.

The main cylinder 1, as shown in FIGS. 1, 2 & 3, consists of a faceplate 11 and a main cylinder 1. On main cylinder 1, an U-shaped slot 12 is bored and a projection 13 is set at the middle of the U-shaped slot 12. In addition, at the bottom of main cylinder 1 there are two notches 14 which are to fix a dead bolt 3 in its place in the main cylinder 1.

Figure 4:
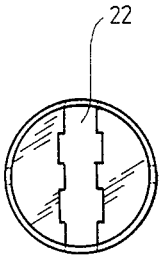
FIG. 4 is a left side view of the extending cylinder of the present invention.
Figure 5:
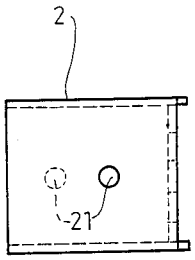
FIG. 5 is a front view of the extending cylinder of the present invention.
Figure 6:
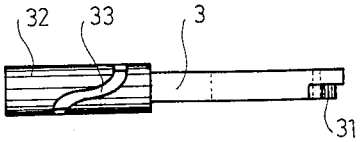
FIG. 6 is a top view of the linking plate of the present invention.
Figure 7:
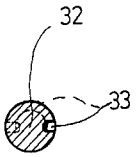
FIG. 7 is a cross-sectioned view of 7—7 line on FIG. 8.
Figure 8:
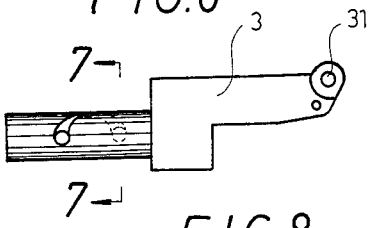
FIG. 8 is a front view of the linking plate of the present invention.
Figure 9:
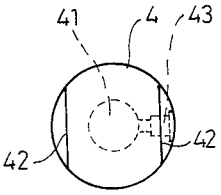
FIG. 9 is a left side view of the dead bolt of the present invention.
Figure 10:
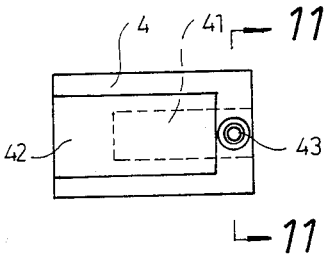
FIG. 10 is a front view of the dead bolt of the present invention.
Figure 11:
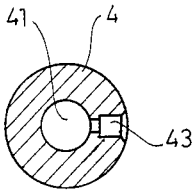
FIG. 11 is a cross-sectioned view of 11—11 line on FIG. 10.

An extending cylinder 2, as shown in FIGS. 1, 4, 5, is to couple with the outside of the main cylinder 1 and makes use of two fixing holes 21 to lock with the projection 13. Two fixing holes 21 are bored just in the symmetrical position facing each other in the body of the extending cylinder 2. At the bottom of the extending cylinder 2 there is a slot 22 which is connected with an assembling plate 5 and has its central line vertical to the line between two fixing holes 21.

In FIGS. 1, 6, 7 & 8, a linking plate 3 has the same structure as the known art which is provided with a linking pin 31 so as to connect with the assembling plate 5. Additionally, there is a round post 32 which is to insert into the dead bolt 4 and set with a screwed notch 33 which extends for the angle of 180 from one end to the other surrounding on a round post 32; at both two ends of the notch 33 there are respectively a vertical wall and a deep hole, and a linear distance between the two ends is equal to that between two fixing holes 21 of the extending cylinder 2.

A dead bolt 4, as shown in FIGS. 1, 9, 10 & 11, has a shaft hole 41 for a round post 32 of the linking plate 3 to extend in and two platforms 42 and a hole 43 for receiving a fixing pin 44, a coil spring 45 and a lid 46 in order.

Figure 12:
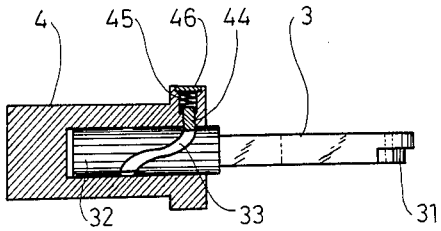
FIG. 12 is a cross-sectioned view of the dead bolt when the dead bolt and the linking plate are assembled in a short size.
Figure 13:
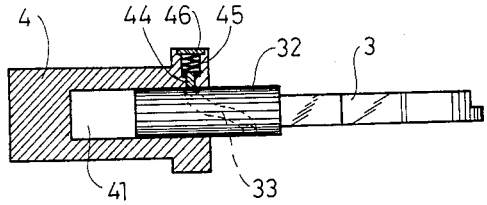
FIG. 13 is a cross-sectioned view of the dead bolt when the dead bolt and linking plate is combined in a long distance.

Next, FIG. 12 shows a cross-sectioned view of the combination of a linking plate 3 and a dead bolt 4. A round post 32 of the linking plate 3 inserts into a shaft hole 41 of the dead bolt 4 and the fixing pin 44 is put into one end of the screwed notch 33 being sealed with a spring 45 and a lid 46. And FIG. 13 shows that when the linking plate 13 is turned for 180 degrees, the fixing pin 44 will come and stand at the other end of the screwed notch 33. Because the deep holes are vertical to the motive direction of the linking plate 3, the fixing pin 44 can function to steadily fix in one of them. Also, the length between the dead bolt 4 and the linking plate 3 is then prolonged to the long distance.

Figure 14:
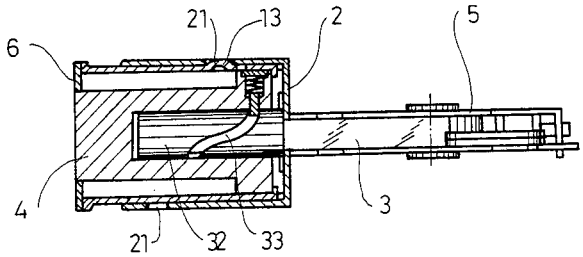
FIG. 14 is a part of a cross-sectioned view of the present invention assembled in the short size.

FIG. 14 shows the combination of a linking plate 3 and a dead bolt 4 together with a main cylinder 1, an extending cylinder 2, an assembling plate 5 and a fixing plate 6. The assembling plate 5 is to connect together with a latch and combines with the lnking pin 31 of the linking plate 3. The distance, by this moment, from the fixing plate 6 to the center of the assembling plate 5 is the short one—the size so-called 60 mm. At this time the projections 13 of the main cylinder 12 is received in one of the fixing holes 21 and a fixing pin 44 is staying at one end of the notch 33. Therefore, the length of the latch cannot be changed.

Figure 15:
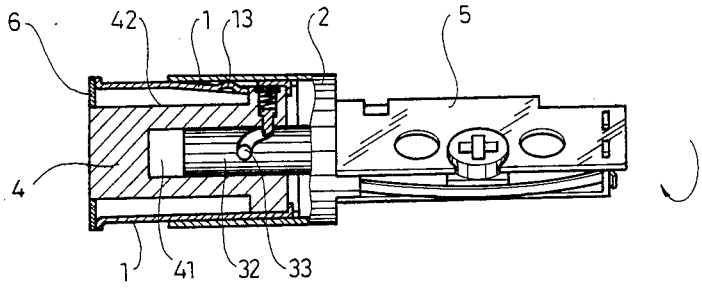
FIG. 15 is a part of a cross-sectioned view of the present invention in the situation of being turned.
Figure 16:
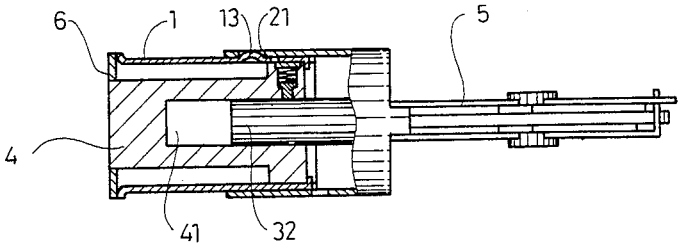
FIG. 16 is a part of a cross-sectioned view of the present invention assembled in the long size.

In FIG. 15, when the assembling plate 5 is turned by means of a foreign force, it will force the extending cylinder 2 to turn around as well, so the round projection 13 pressed by the inner diameter of the extending cylinder 2 makes the part of the main cylinder 1 surrounded by the U-shaped slot 12 pressed down and land on the platform 42 of the dead bolt 4, which has the effect of fixing the dead bolt 4 at a definite position enabling the linking plate 3 to move back along the dead bolt 4. If the assembling plate 5 and the extending cylinder 2 are kept turning around until they have reached the end of the screwed notch 33 being pinned down by the fixing pin 44, as shown in FIG. 16, they have turned for 180 degrees against both the main cylinder 1 and the dead bolt 4; then the projection 13 has been altered to lock in the other of the fixing holes 21 and the distance between the fixing plate and the motive center of the assembling plate 5 has been changed to the long one—the size so-called 70 mm.

By means of turning around the assembling plate to change the distance available for fixing this lock on a door into two sizes, this invention really gives buyers, retailers and manufacturers a practical convenience. It is also possible that the screwed notch 33 be designed to turn for 360 degrees in attaining the same purpose and should be regarded as a kind of embodiment of this invention.

What is claimed is:

1. A length-adjustable auxiliary lock comprising a main cylinder having a front end provided with a face plate and a back end, a dead bolt in the main cylinder, a linking plate extending out the back end of the main cylinder, a cylindrical post on the linking plate having a longitudinal axis and extending into a bore in the dead bolt, a helical track formed on the post and a pin assembly on the dead bolt engaging the track whereby rotation of the linking plate about the longitudinal axis of the post moves the linking late lengthwise relative to the dead bolt to adjust the length of the lock, an extending cylinder surrounding the main cylinder, an assembling plate carried by the extending cylinder and secured to the linking plate at the back of the main cylinder, whereby rotation of the assembling plate and the extending cylinder relative to the main cylinder thereby effects rotation of the linking plate to adjust the length of the lock, the main cylinder having a peripheral wall defining a depressable tongue, a locating projection on said tongue and front and back locating apertures in the extending cylinder for receiving said projection in respective extended and contracted positions of the lock, the extending cylinder and said projection cooperating to depress said tongue when the extending cylinder is moved between said positions, and the dead bolt being formed with a flat surface which is engaged by the tongue when depressed to prevent rotation of the dead bolt.

2. A lock as defined in claim 1 wherein the depressable tongue is defined by a U-shaped slot formed in the wall of the main cylinder.

3. A lock as defined in claim 1 wherein the track extends 180 degrees around the circular post.

* * * * *